United States Patent [19]

Morgan et al.

[11] Patent Number: 4,669,786

[45] Date of Patent: Jun. 2, 1987

[54] CORE BREAKER

[76] Inventors: Vernon B. Morgan, Rte. 1, Box 3, Lester, W. Va. 25865; Janet F. McKinney, 103 Oakrun Rd., Beckley, W. Va. 25801

[21] Appl. No.: 762,393

[22] Filed: Aug. 5, 1985

[51] Int. Cl.[4] ..... E21C 27/24

[52] U.S. Cl. ..... 299/76; 299/78

[58] Field of Search ..... 299/76, 78, 85, 89, 299/91, 9 L, 39

[56] References Cited

U.S. PATENT DOCUMENTS

| | | | |
|---|---|---|---|
| 3,279,856 | 10/1966 | Silks | 299/85 |
| 3,712,679 | 1/1973 | Amoroso | 299/76 |
| 4,316,636 | 2/1982 | Taylor et al. | 299/92 |

*Primary Examiner*—Stephen J. Novosad
*Assistant Examiner*—Thomas J. Odar
*Attorney, Agent, or Firm*—Frank P. Cyr

[57] ABSTRACT

A core breaker comprising a plurality of bits mounted on a suitable support and capable of being readily replaced when the bit becomes worn or damaged during the breaking of a core which is left between the conventional rotating cutter drums of a motorized coal cutting machine.

1 Claim, 4 Drawing Figures

CORE BREAKER

BACKGROUND OF THE INVENTION

In a continuous mining machine, a plurality of sectional cutter drums are mounted for rotation as the mining machine is advanced into a mine and effects a cutting or ripping operation of the coal in a vein of a mine and following the cutting or ripping of the coal the same is deposited on the floor of the mine where it is to be handled in any appropriate manner and delivered to suitable conveyor mechanisms for delivery to a means whereby the coal is removed from the interior of the mine. The sectional cutter drums are mounted for rotation on the frame of the mining machine and extending between the cutter drums are core breakers which are adapted to engage the area between the cutter drums to thereby break up the coal left between the cutter drums to thereby permit for the advance of the mining machine into the vein of the mine.

In the past, core breakers have been employed in this environment but all such core breakers have included a semi-circular support for the core breaker bits which are welded, braised or the like to the support. When the bits are worn or for some other reason, have to be replaced, it has been customary to remove the core breaker from the mining machine to effect a replacement of the bits and to re-weld or re-braise a replacement bit. This necessitates a shut down of the mining machine and the replacement of the worn or otherwise defective bit may take considerable shut down time of the machine.

With the above in mind, it is the main object of the invention to provide a novel manner of mounting the bits on a suitable support whereby the bits may be quickly removed from the support and replaced with a replacement bit with minimum amount of down time for the mining machine.

Another object of the invention is to provide a support for the core breaker bits which will enable one to easily remove a bit to be replaced and a new bit inserted in a suitable opening formed in the support for the core breaker bits.

Another object of the invention is to form a support for the core cutter bits with an opening of differing diameters whereby an expansion ring may be employed for securing the bit to the support.

These and other objects of the invention will appear as the following specification proceeds and with reference to the accompanying drawings.

DESCRIPTION OF THE PREFERRED EMBODIMENT

Figure 1:
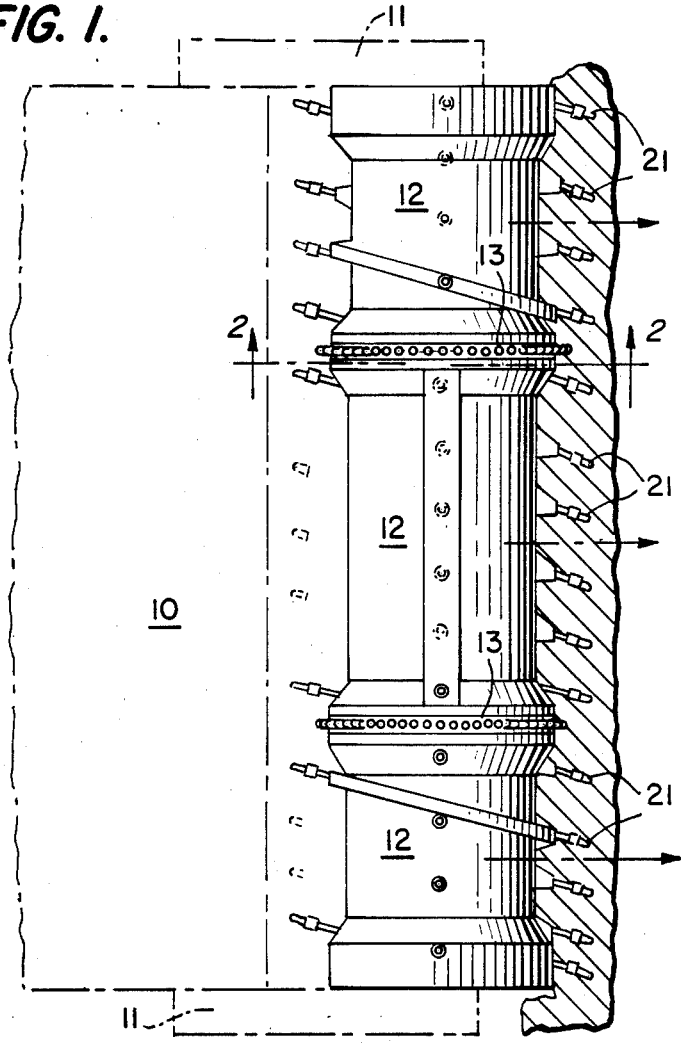
FIG. 1 is a top plan view showing the rotating cutter drums with the core breaker mounted between adjacent cutter drums.
Figure 3:
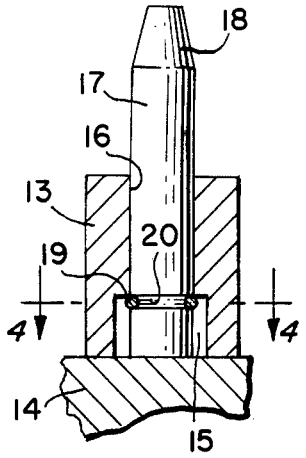
FIG. 3 is a section taken on lines 3—3 of FIG. 2, looking in the direction of the arrows.
Figure 4:
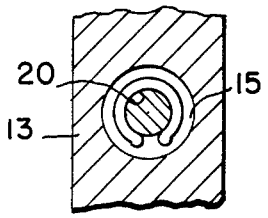
FIG. 4 is a section taken on lines 4—4 of FIG. 3, looking in the direction of the arrows.
Figure 2:
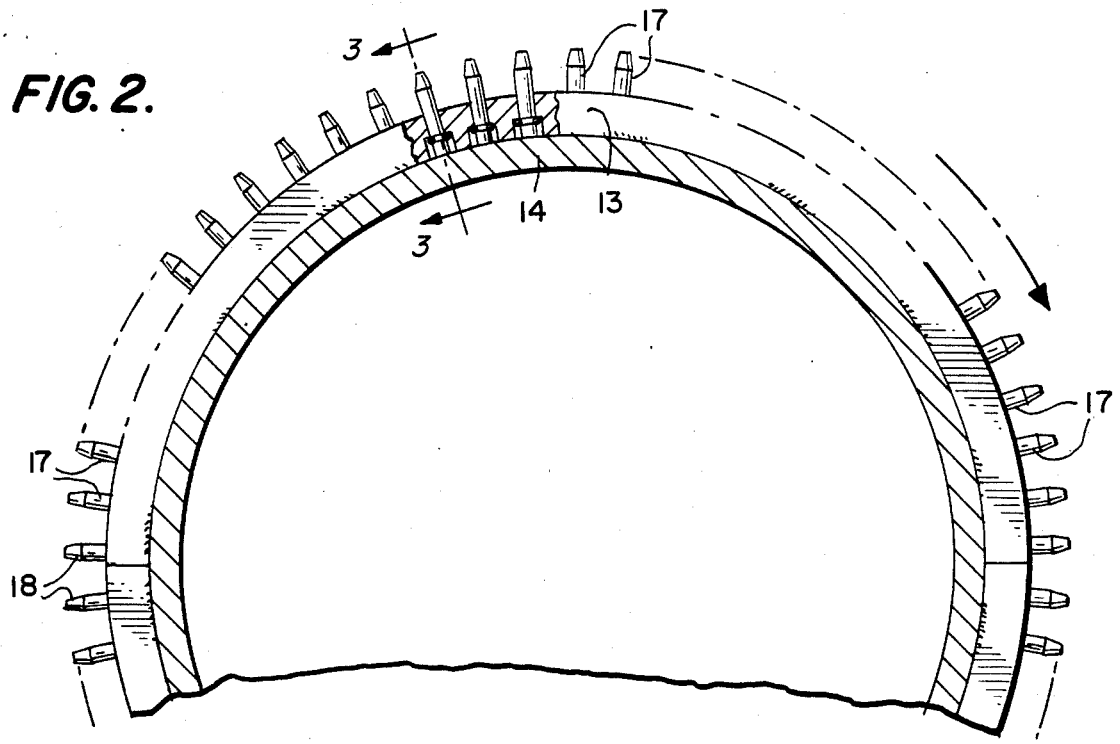
FIG. 2 is a side view showing the support for the core cutter bits taken on lines 2—2 of FIG. 1, looking in the direction of the arrows.

Before undertaking a description of the present invention, it is pointed out that only that portion of the drawings have been shown which form the basis of the present invention, the rotating cutter drums and core breaker are adapted to be mounted in any known manner to the forward part of a conventional motorized mining machine of known construction.

Referring now to the drawings wherein like reference numerals are employed to designate like parts throughout the several views, 10 designates the forward part of a conventional mining machine having the usual supports 11 for the bearings of the conventional rotating drums 12 which, as shown in the drawings, are aligned with the core breaker supports 13 mounted between the adjacent rotating drums 12.

The core breaker of the present invention comprises a support 14 of suitable diameter and is stationarily mounted on a stationary support mounted in any known manner to the forward portion of the mining machine. The core breaker support 13 may be welded or otherwise secured to the support 14 and comprises a plurality of openings 15 and 16 differing in diameter for a purpose to be explained more fully hereinafter.

Mounted in openings 15, 16 of the core breaker 13 are a plurality of bits 17 constructed of a hard metal and having pointed ends 18 which will assist in breaking of the core between the adjacent rotating drums 12. The bits 17 are retained within the openings 15, 16 by means of an expansion ring 19 which snaps into a recess 20 formed at one end of the bits 17 and as best shown in FIG. 1 of the drawings, the core breaker bits 17 extend outwardly to a distance approximating the extent of the bits 21 mounted on the rotating drums 12.

The employment of the expansion rings 19 in securing the bits 17 of the core breaker will permit for the easy removal and replacement of the bits. To replace a bit, one only needs to use pliers or similar hand tool and exert a pulling force on the bit whereby the expansion ring will contract, thus permitting the bit to be withdrawn from the core breaker and a replacement bit inserted into the core breaker.

As can be appreciated, the mining machine will gradually advance into the mine and as the core breaker is also caused to be advanced into the mine, the core breaker will engage the coal left between the adjacent rotating drums to thus break up the coal in that area so as to facilitate the continued advancement of the mining machine into the mine.

We claim:

1. In a continuous mining machine having at least a pair of horizontally spaced and aligned rotatable cutter drums, an improved core breaker operatively associated with the cutter drums and comprising:

(A) an arcuate fixed support disposed between said drums;

(b) an elongated bit holder fixed to and extending outwardly from said support;

(C) the holder structure having a series of longitudinally spaced, core breaker bit accomodating apertures extending therethrough;

(D) each said aperture being defined by a smaller diameter outer bore, a larger diameter inner bore and a shoulder extending generally normal to the aperture axis separating the bores;

(E) a bit element and expansion ring assembly disposed in operative association with said cutter drums, accommodated in each said aperture and comprising:

(1) an elongated body adapted to closely but removably extend through and from the smaller bore of said aperture;

(2) a shank portion extending through the larger bore and having an end face adapted to seat on the fixed support;

(3) the bit having an annular groove thereabout that is normal to the axis of the bit and the upper edge of which is co-incident with said shoulder;

(4) said expansion ring being a split ring, disposed in said groove and in expansion being at least in part laterally extending from said groove so as to underlie said shoulder whereby the bit is normally positively retained in said assembly; and (5) said expansion ring being fully compressible into said annular groove whereby by exerting an extracting-pulling force on the bit extending from the smaller bore, the said laterally extending portion of the ring is fully compressed into the groove by the wall defining the smaller bore and the bit and ring assembly is fully extracted from the aperture of said bit holder and whereupon a new similar bit and ring assembly may be inserted into the holder.

* * * * *

UNITED STATES PATENT AND TRADEMARK OFFICE

CERTIFICATE OF CORRECTION

PATENT NO. : 4,669,786

DATED : June 2, 1987

INVENTOR(S) : Vernon B. Morgan, Janice F. McKinney, Larry B. McKinney and W. Douglas Blackburn, Jr.

It is certified that error appears in the above-indentified patent and that said Letters Patent is hereby corrected as shown below:

Larry B. McKinney, 103 Oakrun Road, Beckley, WV 25801, W.D. Blackburn, Jr., 31 Robin Place, Beckley, W. Va. 25801, are added as inventors.

Signed and Sealed this

Seventeenth Day of January, 1995

*Attest:*

Bruce Lehman

BRUCE LEHMAN

*Attesting Officer*

*Commissioner of Patents and Trademarks*